US006408727B1

(12) United States Patent
Harris et al.

(10) Patent No.: US 6,408,727 B1
(45) Date of Patent: Jun. 25, 2002

(54) PAPER CUTTER USING A BLADE LIFTING MECHANISM

(75) Inventors: Richard Hunter Harris; Jeff David Thomas; Kevin Hunter Vorhees, all of Raleigh, NC (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/481,353

(22) Filed: Jan. 12, 2000

(51) Int. Cl.[7] ..... B26D 5/08

(52) U.S. Cl. ..... 83/566; 83/563; 83/584; 83/949

(58) Field of Search ..... 83/649, 949, 563, 83/566, 568, 584, 697, 695

(56) References Cited

U.S. PATENT DOCUMENTS

| | | | | | |
|---|---|---|---|---|---|
| 3,250,165 | A | | 5/1966 | Schoonmaker et al. | 83/203 |
| 3,580,123 | A | * | 5/1971 | Westra | 83/380 |
| 4,463,693 | A | | 8/1984 | Dreier et al. | 112/128 |
| 5,237,901 | A | | 8/1993 | Warga, III | 83/583 |
| 5,360,213 | A | * | 11/1994 | Crowley et al. | 270/39 |
| 5,408,908 | A | * | 4/1995 | Rosenthal et al. | 83/584 |
| 5,482,389 | A | * | 1/1996 | Bickoff et al. | 400/621 |
| 5,749,277 | A | | 5/1998 | Walker | 83/563 |
| 5,832,802 | A | * | 11/1998 | Warthen et al. | 83/555 |
| 6,026,723 | A | * | 2/2000 | Sakai | 83/221 |
| 6,105,478 | A | * | 8/2000 | Cestonaro et al. | 83/175 |

* cited by examiner

*Primary Examiner*—M. Rachuba
*Assistant Examiner*—Kim Ngoc Tran
(74) *Attorney, Agent, or Firm*—J. Bruce Schelkopf; Ronald V. Davidge

(57) ABSTRACT

A printer mechanism includes a single motor turning a system drive gear in a paper feeding direction, and in a cam driving direction, opposite the paper feeding direction. When the system drive gear is turned in the paper feeding direction, a paper feeding spring clutch drives a paper feed roll with the system drive gear. When the system drive gear is turned in the cam driving direction, a drive cam is driven by a cam driving spring clutch. The drive cam has a first surface driving a moving knife blade across a stationary knife blade in a cutting direction, and in a return direction opposite the cutting direction. With this movement in the cutting direction, the moving knife is held against the stationary knife blade, and, with movement in the return direction, the moving knife is moved away from the stationary knife blade, by means of a second surface of the drive cam. Provision is made to allow the cam driving clutch and cam to return to an original configuration after an event in which knowledge is lost of the operating mode and position of the mechanism.

20 Claims, 3 Drawing Sheets

PAPER CUTTER USING A BLADE LIFTING MECHANISM

BACKGROUND OF THE INVENTION

1. Field of the Invention

This invention relates to a means for cutting a paper web into a number of pages, and, more particularly, to a means for cutting a paper web pulled from a supply roll in a point-of-sale terminal into a number of sales receipts.

2. Description of the Related Art

Many machines handling paper, such as printers, include mechanisms for cutting a paper web into a number of sheets, with each paper cutting mechanism generally being a shear device, in which one blade passes across another blade to cut the paper.

A widely-used paper cutting mechanism is a shear paper cutter, in which one blade passes over the other in a straight path. However, when the moving blade returns after cutting the paper, it tends to bend the edge of the paper back, sometimes causing a jam during subsequent movement of the paper. Furthermore, the blades contact one another during movement in both the cutting direction and the reverse direction, causing unnecessary blade wear and power consumption.

A number of shearing devices are described in the patent literature. For example, U.S. Pat. No. 3,250,165 describes a paper cutter using a severing device including a resilient mounting to ensure that a traveling point contact occurs between the blades during shearing. This is achieved by locating a portion of a movable blade in back of a fixed blade, with the moving blade being angled with respect to the fixed blade to form a "V", so that the apex of the "V" travels along the fixed blade during the cutting stroke. Also, the severing device directs the leading end of the material, from which a length has been severed, back into a given path.

U.S. Pat. No. 5,749,277 describes a cutting mechanism for a receipt printing machine, which has paper dispensed from a paper-supply roll. The cutting mechanism has a "V"-shaped guillotine blade that is held in a blade holder. The blade is driven through the blade holder against a stationary blade and into cutting contact with a paper web containing receipt indicia.

U.S. Pat. No. 5,237,901 describes a shear assembly for cutting hard brittle materials, such as amorphous metals used in transformers. A compensating link arrangement is operatively associated with one of two blades in the shear assembly. The angular position of the links may be selectively adjusted to alter a horizontal force component that counteracts a separation force associated with the blades during a cutting stroke.

What is needed in the devices of each of these patents is a mechanism for separating the blades following the cutting stroke, in order to reduce wear, noise, and power consumption.

The *IBM Technical Disclosure Bulletin*, Vol. 40, No. 4, April, 1997, describes a combination paper feed and cutter drive for a printer, eliminating a need for a separate motor to drive the paper cutter. A single stepper motor, a gear train, and two one-way clutches are used to drive paper through a thermal print mechanism and to drive a scissors-type cutter embodiment. One direction of the motor is used to feed the receipt paper, and the other direction is used to cut the receipt. The motor drives an idler gear, which in turn drives a thermal platen roller through a thermal clutch assembly which is a one-way clutch causing the thermal platen roller to rotate only in one direction. The motor also drives a cutter clutch drive gear, which in turn drives a shaft within a cutter clutch assembly which is coupled through a one-way clutch to a gear that drives the cutter drive gear. The cutter drive gear only rotates in its respective direction, except for small rotations in the reverse direction to ensure that the cutter is in an open position while paper is being fed. Reverse drag of the cutter clutch assembly provides a torque to reverse the cutter drive gear.

A general problem associated with using a single motor or drive to provide two or more functions, as described in the preceding paragraph, is that the mechanism can become jammed or otherwise inoperable because information regarding its state of operation can be lost in the event of an electrical power failure or in the event that parts of the mechanism are manually moved during an attempt to repair the mechanism or to clear a jam condition. What is needed is a mechanism which can be returned to a normal starting point even if such events occur.

BRIEF SUMMARY OF THE INVENTION

It is a first objective of the present invention to provide a means for holding cutting blades within a paper cutter together during a cutting stroke, and for holding these blades apart during a return stroke following the cutting stroke.

It is a second objective of the present invention to provide a means for returning a paper cutting mechanism, operating in an alternating fashion with a paper feeding mechanism, to an operational starting point following a power failure or following the manual movement of parts within the mechanism.

It is a third objective of the present invention to minimize the width of a point-of-sale printer.

In accordance with a first aspect of the present invention, there is provided a paper cutter for a printer, in which the paper cutter includes a stationary knife blade, a moving knife blade, a blade holder, and first and second drive mechanisms. The blade holder holds the moving knife blade and moves with the moving knife blade. The first drive mechanism moves an edge of the moving knife blade in a first direction across an edge of the stationary knife blade to cut a paper web extending between the moving knife blade and the stationary knife blade, and additionally moves the edge of the moving knife blade opposite the first direction. The second drive mechanism moves the edge of the moving knife blade in a second direction away from the stationary knife blade and opposite the second direction into contact with the stationary knife blade.

The moving knife blade is moved in the first direction in contact with the stationary knife blade. The moving knife blade is moved opposite the first direction as the moving knife blade is held away from the stationary knife blade.

DETAILED DESCRIPTION OF THE INVENTION

Figure 1:
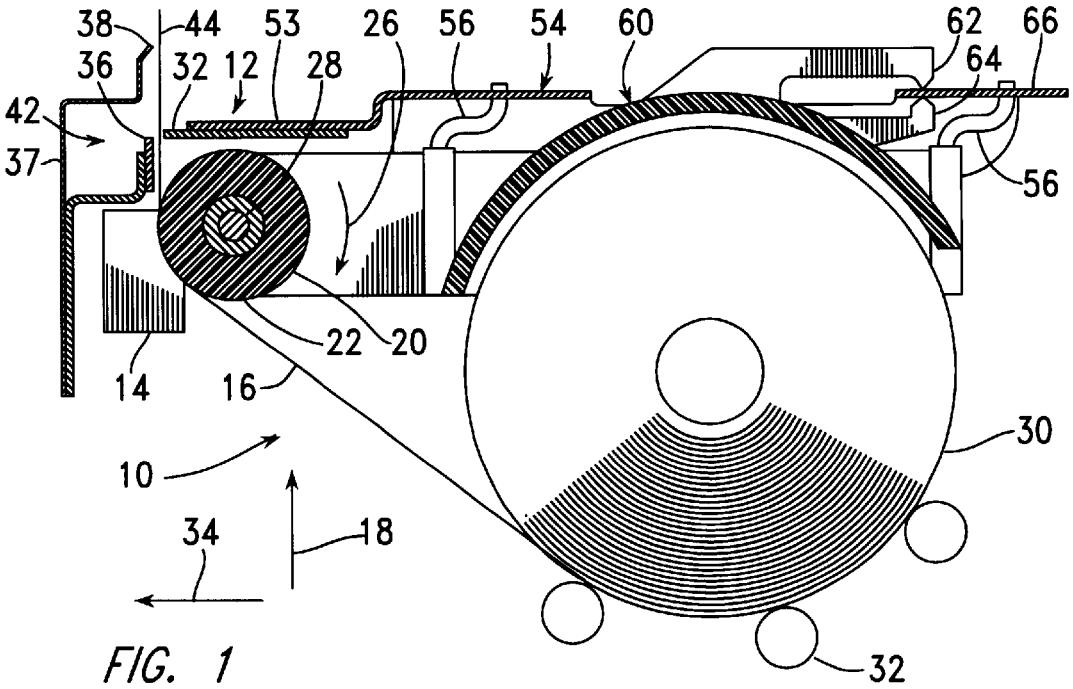
FIG. 1 is a vertical cross-sectional view of a point-of-sale printer mechanism having a paper cutter built in accordance with the present invention.

FIG. 1 is a vertical cross-sectional view of a point-of-sale printer mechanism 10 having a paper cutter 12 built in accordance with the present invention. In this example, the printer is configured as a point-of-sale printer generating individual sales receipts by means of a thermal print head 14, across which paper from a web 16 is moved in the upward direction of arrow 18. The paper is moved through the printing process by rotation of a roll platen 20, which has an elastomeric layer 22 to provide frictional properties needed to drive the paper while forming a surface which is compliant with the thermal print head 14. When the paper is to be moved, the platen 20 is rotated in the paper advancing direction of arrow 26 by means of a rotatable shaft 28 to which the platen 20 is attached. The resulting movement of the web 16 causes additional paper to be pulled from a supply roll 30, which is placed on rollers 32 to facilitate rotation of the roll 30. Between the printing of individual sales receipts, the paper cutter 12 is operated to cut the paper web 16 into individual receipts. The paper is cut by the movement of a moving knife blade 32 in the forward direction of arrow 34 across the upper surface of a stationary knife blade 36.

The point-of-sale printer mechanism 10 also includes a separate cutting member 37, having a serrated cutting edge 38, which can be used to cut the paper web 16, for example when a new supply roll 30 is installed, without operation of the paper cutting mechanism. This separate cutting member 37 is not shown in other views, in order to avoid obscuring the paper cutting mechanism.

Figure 2:
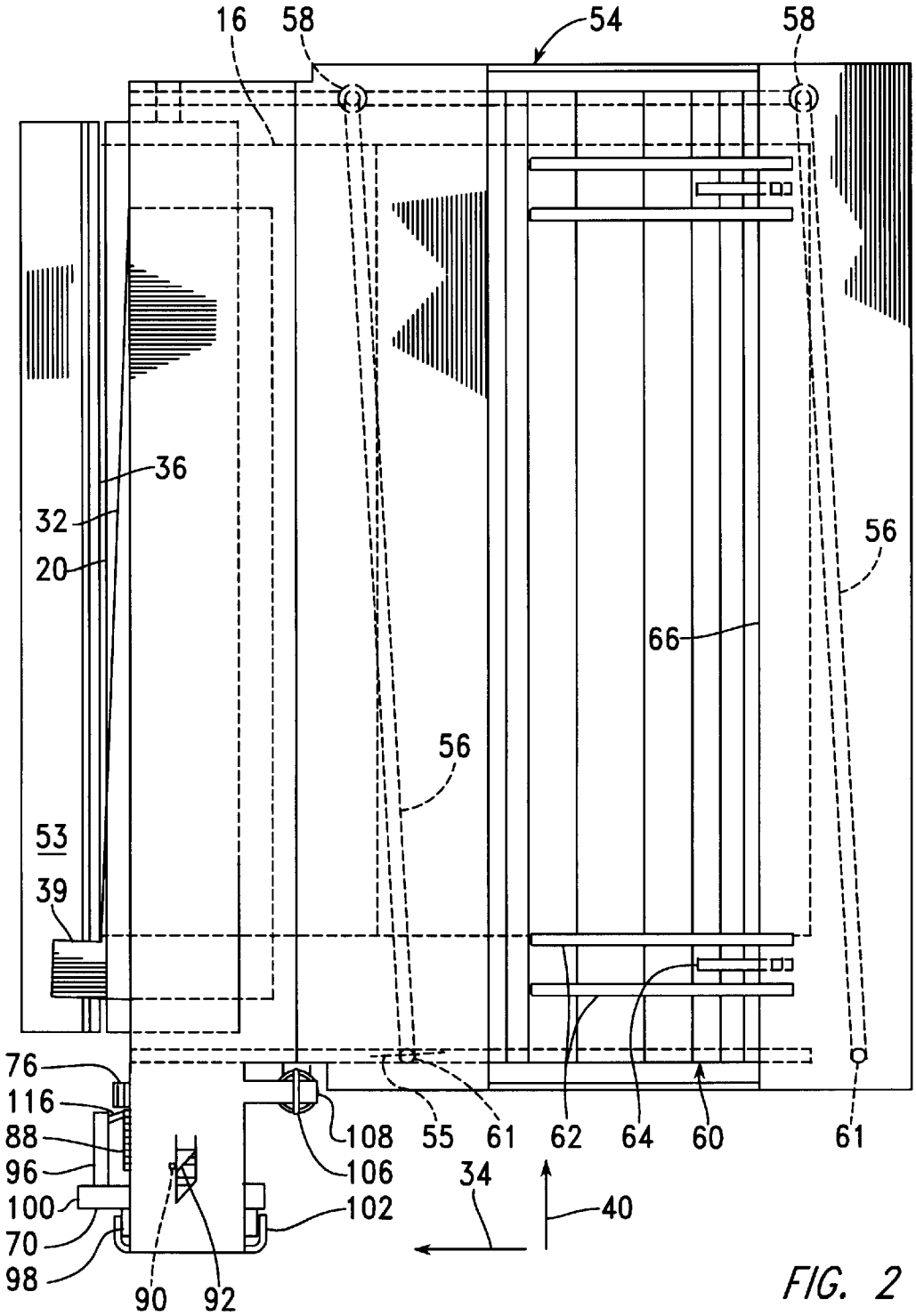
FIG. 2 is a plan view of the printer mechanism of FIG. 1.

FIG. 2 is a plan view of the printer mechanism 10 of FIG. 1, showing the moving knife blade 32 extending from a tab 39 to the left, in the direction of arrow 40, and slightly rearward, opposite the direction of arrow 34.

Figure 3:
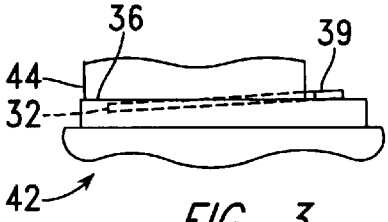
FIG. 3 is a fragmentary front elevation of the printer mechanism of FIG. 1, showing a moving knife blade therein in a position allowing paper to be fed during a printing process.

FIG. 3 is a fragmentary front view of the paper cutting region 42 of the printer mechanism 10. FIGS. 2 and 3 show the moving knife blade 32 in a position allowing paper to be fed during the process of printing the receipt. A wedge-shaped gap, as viewed from above, is provided between the moving knife blade 32 and the stationary knife blade 36. As viewed from the front, in FIG. 3, the moving knife blade extends downward and to the left, in the direction of arrow 40, from the forward-extending tab 39. During printing, an upper end portion 44 of the paper web 16 is fed through this gap. With the moving knife blade 32 withdrawn rearward to provide this gap, the tab 39 still extends over an end of the stationary knife blade 36, so that the moving knife blade 32 cannot jam behind the stationary knife blade 36.

Figure 4:
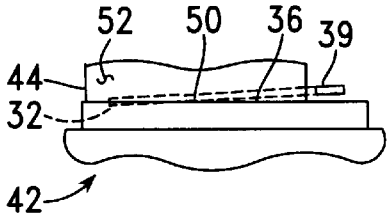
FIG. 4 is a fragmentary front elevation of the printer mechanism of FIG. 1, showing the moving knife blade therein cutting through a paper web to form individual documents.

FIG. 4 is another fragmentary front view of the paper cutting region 42 of the printer mechanism 10, showing the moving knife blade 32 cutting through the upper portion of the web 44, having cut partially through this web. The cutting operation occurs as the moving knife blade 32 is moved forward, in the direction of arrow 36. Due to the inclination of the cutting edge of the moving knife blade 32, both in the horizontal plane as shown in FIG. 2 and in the vertical plane, as shown in FIG. 4, the cutting point 50, where the cutting edges of the knife blades 32, 36 come together, moves to the left, in the direction of arrow 34, as the cutting process proceeds. Also, during this cutting process, the cutting blade moves upward, in the direction of arrow 18. The web 44 is preferably positioned so that a portion 52 of the web 44 extends beyond the area in which the knife blades 32, 36 come together, so that a strip of unseparated web extends beyond each cut. When this is done, the individual receipt pages remain together until they are easily separated by tearing apart.

After the cutting process has been completed, the moving knife blade 32 must be returned rearward, opposite the direction of arrow 34, into its initial position, as shown in FIGS. 2 and 3. In accordance with the present invention, the moving knife blade 32 is moved upward, in the direction of arrow 18, before it is moved rearward, and is held upward, out of contact with the stationary knife blade 36 during this rearward motion. In this way, the process of wearing the knife blade surfaces is greatly reduced, and, since the cut edge of the paper is not dragged rearward with the rearward motion of the moving knife blade 32, a "popping sound" of the paper is avoided.

The mechanism for mounting the moving knife blade 32 will now be discussed, with reference being made FIGS. 1 and 2. The moving knife blade 32 is mounted beneath a forward-extending shelf-portion 53 of a blade holder 54, which is inclined from one end to another to provide the inclination of the blade 32 shown in FIGS. 3 and 4. The moving knife blade 32 is attached to a blade holder 54, which is constrained to move along a curved path 55 in a horizontal plane (i.e. as viewed from above, in FIG. 2), by means of a pair of link arms 56, which are pivotally mounted in associated holes 58 within an inner frame 60, and in associated holes 61 in the blade holder 54. Since these link arms 56 are equal in length, and since the distance between the holes 58 is equal to the distance between the holes 61, a parallelogram linkage is formed, allowing the knife blade holder 54 to be translated along a curved path while preventing its rotation. In a vertical plane (i.e. as viewed in FIG. 1), the blade holder 54 is constrained to pivot about mutually aligned fulcrum points established by upper support tabs 62 and lower support tabs 64, all of which extend as portions of the inner frame 60 along opposite sides of a cross strip 66 forming a portion of the blade holder 54.

Figure 5:
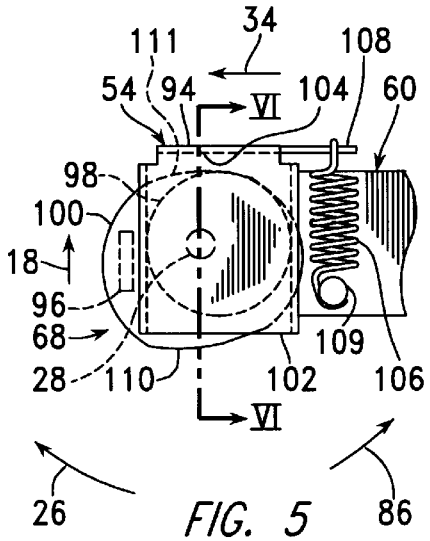
FIG. 5 is a fragmentary right end elevation of the printer mechanism of FIG. 1, showing a mechanism used to drive a paper feed and the moving knife blade therein.

FIG. 5 is a fragmentary right end view of the printing mechanism 10, showing a cam mechanism 68 used for moving the blade holder 54 in the forward direction of arrow 34 to cut the paper web 16, for moving the blade holder 54 opposite the direction of arrow 34 to disengage from the paper so that paper can be fed during the printing process, and for lifting the blade holder 54, in the direction of arrow 18, so that the moving blade 32 is held away from the stationary blade 36 (both shown in FIG. 1) as the blade holder 54 is driven opposite the direction of arrow 34.

Figure 6:
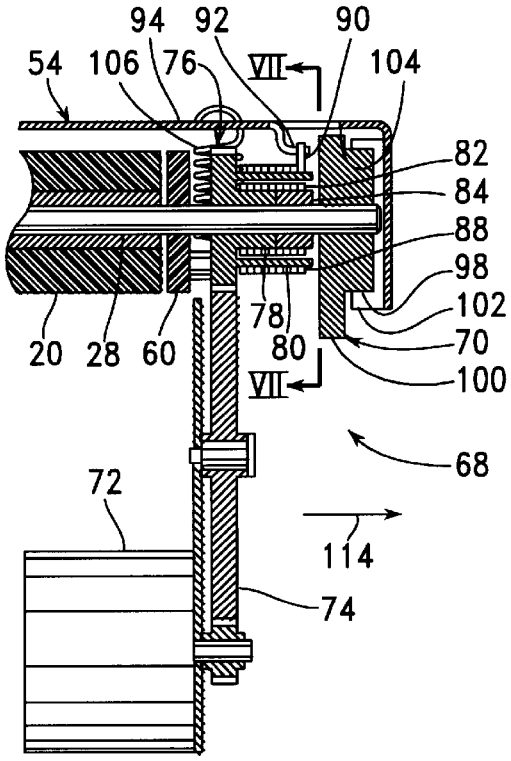
FIG. 6 is a fragmentary longitudinal cross-sectional elevation of the drive mechanism of FIG. 5, taken as indicated by section lines VI—VI therein.

FIG. 6 is a longitudinal cross-sectional view of the cam mechanism 68 of FIG. 5 taken as indicated by section lines VI—VI in FIG. 5.

Referring to FIGS. 5 and 6, both the rotation of platen 20 to drive the paper web 16 (shown in FIG. 1) through the printing process, and the rotation of a drive cam 70 to effect the paper cutting process through the movement of the blade holder 54, are alternately driven by a motor 72, through a gear train 74 engaging a system drive gear 76. The system drive gear 76 includes an inner driving mandrel 78 and an outer driving mandrel 80.

A paper drive clutch spring 82 extends over the inner drive mandrel 78 and over a shaft driving mandrel 84 attached to the platen drive shaft 28. The clutch spring 82 is wound to operate as a one-way clutch, so that, when the system drive gear 76 is turning in the paper feeding direction of arrow 26, frictional torque between the paper drive clutch spring 82 turning with the system drive gear 76 and the initially stationary shaft driving mandrel 84 causes the clutch spring 82 to tighten on the mandrel 84, so that the mandrel 84 is engaged to rotate with the system drive gear 76. This rotation of the mandrel 84, which is attached to the shaft 26 causes the shaft 26 and, in turn, the platen roll 20, to rotate with the system dive gear 76.

On the other hand, when the system drive gear 76 is driven in the cam driving direction of arrow 86, opposite the paper driving direction of arrow 26, the frictional torque between the paper drive clutch spring 82 turning with the system drive gear 76 and the stationary shaft driving mandrel 84 causes the paper drive clutch spring 82 to release the mandrel 84, so that this mandrel 84 remains stationary, being held by friction between the platen 20 and the print head 14 (shown in FIG. 1).

Figure 7:
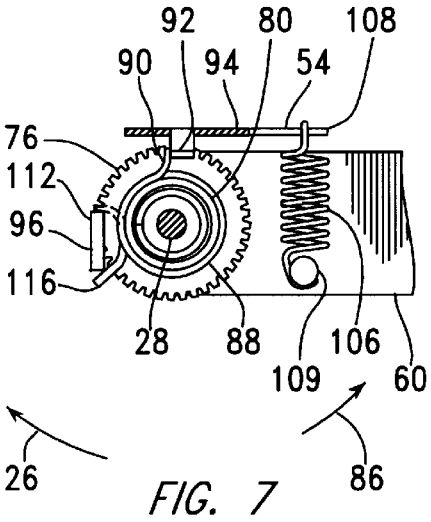
FIG. 7 is a fragmentary transverse cross-sectional elevation of the drive mechanism of FIG. 5, taken as indicated by section lines VII—VII in FIG. 6 to show clutch springs within the drive mechanism.

FIG. 7 is a transverse cross-sectional view of the cam mechanism 68, taken as indicated by section lines VII—VII in to show the configuration of the ends of a cam driving clutch spring 88, which extends over the outer driving mandrel 80. The cam driving clutch spring 88 is wound to lightly engage the outer driving mandrel 80, and therefore to turn with the mandrel 80 in the absence of a external force. When an external force is applied to a right end tab 90 of the clutch spring 88 in the direction of arrow 86, the clutch spring 88 tends to unwind, loosening its engagement on the outer driving mandrel 80. Thus, when the clutch spring 88 is driven by friction with the outer driving mandrel 80 of the system driving gear 76 in the paper driving direction of arrow 26 into the position shown in FIG. 7, a reaction force in the direction of arrow 86, resulting from contact between the right end tab 90 of the clutch spring 88 and an interposing tab 92 extending downward from a rightward-extending portion 94 of the blade holder 54.

On the other hand, when the cam driving clutch spring 88 is driven in the cam driving direction of arrow 86 by means of friction with the outer driving mandrel 80 of the system driving gear 76, following contact between the right end tab 90 of the clutch spring 88, an external force operating in the direction of arrow 26 is applied to the right end tab 90 from a tab 96 extending inward from the drive cam 70, causing the clutch spring 88 to wind more tightly on the outer driving mandrel 80. As this occurs, the clutch spring 88 begins to drive the drive cam 70 in the direction of arrow 86.

Placing the inner driving mandrel 78, the shaft driving mandrel 84, and the paper drive clutch spring 82 in a concentric arrangement within the outer mandrel 80 and the cam driving clutch spring fulfills an objective of minimizing the width of the print mechanism 10, in terms of its extension beyond the edges of the paper web 16.

Referring to FIGS. 1, 5 and 6, the drive cam 70 includes an eccentric peripheral surface 98 and a lifting peripheral surface 100. The eccentric peripheral surface 98 turns within a channel 102 formed at the outer end of the rightward-extending portion 94 of the blade holder 54, causing the blade holder 54 to move forward, in the direction of arrow 34, in a cutting stroke to cut the paper web 16 and, subsequently, opposite the direction of arrow 34 in a return stroke to return the moving knife 32 blade to a position in which the movement of the paper web 16 during the printing process is allowed and in which the moving knife blade 32 is prepared to begin the next cutting stroke.

During the return stroke, the lifting peripheral surface 100, turning under an adjacent contact surface 104 extending along the lower surface of the rightward-extending portion 94 of the blade holder 54, causes the moving knife blade 32 to be lifted out of contact with the stationary knife blade 36. Thus, during the cutting stroke, the moving knife blade 32 moves in contact with the stationary knife, with the lifting peripheral surface 100 being configured to be spaced away from the contact surface 104. Near the end of the cutting stroke, the lifting peripheral surface 100 moves into contact with the adjacent contact surface 104, lifting the moving knife blade 32 out of contact with the stationary knife blade 36. Near the end of the return stroke, the lifting peripheral surface 100 moves out of contact with the adjacent contact surface 104, bringing the forward extending tab 39 of the moving knife blade 32 into contact with the stationary knife blade 36.

The blade holder 54 is pulled downward by means of an extension spring 106 stretched between the a spring tab 108 of the blade holder 54 and a spring retaining portion 109 of the inner frame 60, so that, depending on the position of the drive cam 70, either the moving knife blade 32 is held in contact with the stationary knife blade 36 or the contact surface 104 is held in contact with the lifting peripheral surface 100 of the drive cam 70.

Continuing to refer to FIGS. 1, 5, and 6, and referring additionally to FIG. 7, the process of preparing a document, such as a sales receipt, begins with printing the necessary information as the system drive gear 76 is rotated in the paper feeding direction of arrow 26, driving the paper web 16 past the print head 14. This process continues until all of the necessary information has been printed, with suitable margins being created above and below the printed information. The document may be of a length determined by the information being printed, as there is no need to rotate the system drive gear 76 through an integral number of revolutions.

When this printing process has been completed, rotation of the system drive gear 76 in the direction of arrow 26 is stopped, and rotation of this drive gear 76 in the cam driving direction of arrow 86 is begun. Since the cam driving clutch spring 88 is wound tightly enough on the outer mandrel 80 to turn with this mandrel 80 in the direction of arrow 86, the clutch spring 88 begins to turn with the drive gear 76. When the right end tab 90 of the clutch spring 88 contacts the top of the tab 96 extending inward from the drive cam 70, the right end tab 90 begins to push the tab 96 so that the drive cam 70 also turns with the system drive gear 76. During a first portion of a revolution of the drive cam 70, the eccentric peripheral surface 98 drives the blade holder 54 forward, in the direction of arrow 34, with the paper web 16 being cut as the rightward-extending portion 94 of the blade holder 54 moves upward, in the direction of arrow 18, due to sliding contact between the moving knife blade 32 and the stationary knife blade 36. This upward movement of the rightward-extending portion 94 maintains a gap between the lifting peripheral surface 100 of the drive cam 70 and the contact surface 104 during the forward movement of the blade holder 54.

Next, with continued rotation of the drive cam 70 in the direction of arrow 86, a rising portion 110 of the lifting peripheral surface 100 runs along the contact surface 104 to lift the moving knife blade 32 away from the stationary knife blade 36. With movement of the knife blade opposite the direction of arrow 34, in further response to the movement of the eccentric peripheral surface 98 of the drive cam 70, the lifting peripheral surface 100 continues to hold the contact surface 104 upward, preventing contact between the knife blades 32, 36 and allowing the right end tab 90 to pass beneath the interposing tab 92 extending downward from a rightward-extending portion 94 of the blade holder 54. After the right end tab 90 passes under the interposing tab 92, a downward sloping portion 111 of the lifting peripheral surface 100 allows the rightward-extending portion 94 of the blade holder 54 to move downward, restoring contact between the knife blades 32,36. Rotation of the system drive gear 76 in the direction of arrow 86 is continued until the right end tab 90 reaches an intermediate position indicated by dashed lines 112, with this rotation then being stopped to await the next printing operation. In this way, the drive cam 70 is moved by the right end tab 90 into the position shown in FIG. 5, in preparation for the next paper cutting cycle.

When the next printing operation begins, a first portion of the rotation of the system drive gear 76 in the paper feeding direction of arrow 26 rotates the cam driving clutch spring 88, also in the direction of arrow 26, with the drive cam 70 remaining stationary as the right end tab 90 moves away from the cam driving tab 96, until contact between the right end tab 90 and the interposing tab 92 causes the cam driving clutch spring 88 to begin to unwrap and to release its frictional grip of the outer mandrel 80.

The motor 72 is preferably a stepper motor, which is driven by a signal additionally providing an indication of the angle through which the motor 72 is driven. This indication is preferably used both to establish the locations at which lines of printing are placed with the system drive gear 76 being turned in the direction of arrow 26 and to determine the angle through which the system drive gear 76 is rotated in the direction of arrow 86 to cut the paper web 16. The rotation of the system drive gear in the cam-driving direction of arrow 86 may be stopped within a range of positions, as the actual position into which the drive cam 70 is driven before stopping is not critical.

A power failure can cause a loss of the information regarding the mode (printing or cutting) in which the printing mechanism 10 is operating and the angle through which the drive cam 70 has been driven. Furthermore, manual movement of the platen 20 in an attempt to clear a paper jam can cause movement of the cam driving clutch spring 88, and the knife frame 54 can be manually moved under certain conditions. For such reasons, it is highly desirable to configure the cam mechanism 68 to provide for a return of the mechanism to the position shown in FIG. 5 even following the establishment of an arbitrary relationship between the cam driving clutch spring 88 and the drive cam 70. To this end, the interposing tab 92 is slanted, in a manner best shown in FIG. 2, so that when the right end tab 90 is driven into the interposing tab 92 in the direction of arrow 86 without the drive cam 70 being in position to lift the interposing tab 92 to clear the right end tab 90, this tab 90 is moved outward, in the direction of arrow 114, passing the interposer tab.

Also, a left end tab 116 of the cam driving clutch spring 88 pushes the cam driving tab 96 in the direction of arrow 26 when these tabs come into contact with one another as the clutch spring 88 is rotated in the direction of arrow 26. This condition occurs if a printing cycle, with the system drive gear turning in the direction of arrow 26, is initiated when the drive cam 70 is turned to a position corresponding to a mid point of the paper cutting cycle. When this happens, the movement of the cam driving clutch spring 88 and the drive cam 70 is stopped when the right end tab 90 comes into contact with the interposing tab 92, leaving the drive cam 70 in its initialized position, as shown in FIG. 5.

While the invention has been described in its preferred form or embodiment with some degree of particularity, it is understood that this description has been given only by way of example, and that numerous changes in the details of construction, fabrication, and use, including the combination and arrangement of parts, may be made without departing from the spirit and scope of the invention.

What is claimed is:

1. Apparatus for feeding a paper web, and for cutting said paper web into segments, wherein said apparatus comprises:

a stationary knife blade;

a moving knife blade;

a blade holder holding said moving knife blade and moving with said moving knife blade;

a drive cam including a first cam surface turning in engagement with said blade holder, moving an edge of said moving knife blade in a first direction across and edge of said stationary knife blade to cut said paper web with said paper web extending between said moving knife blade and said stationary knife blade, and subsequently moving said edge of said moving knife blade opposite said first direction;

a paper feed roll feeding said paper web;

a cam driving clutch mandrel;

a paper feed driving clutch mandrel;

a paper feed driven clutch mandrel connected to turn said paper feed roll;

a motor driving said cam driving clutch mandrel and said paper feed driving clutch mandrel in a cam driving direction, and opposite said cam driving direction;

a cam driving tab extending from said drive cam adjacent said cam driving clutch mandrel;

an interposer tab extending from said blade holder adjacent said cam driving clutch mandrel;

a cam driving clutch spring extending around said cam driving clutch mandrel, wherein said cam driving clutch spring includes a first end tab extending outward to engage a first side of said cam driving tab and said interposer tab, wherein said cam driving clutch spring engages said cam driving clutch mandrel when a force is applied to said first end tab opposite said cam driving direction, and wherein said cam driving clutch spring disengages said cam driving clutch mandrel when a force is applied to said first end tab in said cam driving direction; and a paper feed driving clutch spring extending around said paper feed driving clutch mandrel and said paper feed driven clutch mandrel, wherein said paper feed driving clutch spring engages said paper feed driven clutch mandrel to turn said paper feed driven clutch mandrel with said paper feed driving clutch mandrel when said paper feed driving clutch mandrel is driven opposite said cam driving direction.

2. The apparatus of claim 1, wherein said interposing tab extends at an acute angle with respect to a path of motion of said first end tab, allowing said first end tab to move around said interposing tab as said first end tab passes adjacent said interposer tab in said cam driving direction with said first end tab out of contact with said cam driving tab.

3. The apparatus of claim 2, wherein said cam driving clutch spring additionally includes a second end tab engaging a second side of said cam driving tab, opposite said first side of said cam driving tab, as said clutch spring is rotated opposite said cam driving direction, and said cam driving clutch spring engages said clutch mandrel when a force is applied to said second end tab in said cam driving direction.

4. The apparatus of claim 1, wherein said drive cam additionally includes a second cam surface moving said interposer tab away from said first end tab as said first end tab passes adjacent said interposer tab with said first end tab in contact with said cam driving tab, said second cam surface moves said interposer tab into alignment with said first end tab as said first end tab moves beyond said interposer tab in said cam driving direction with said first end tab in contact with said cam driving tab, and said first end tab causes said cam driving clutch spring to disengage from said cam driving clutch mandrel as said first end tab engages said interposer tab with said cam driving clutch mandrel being driven opposite said cam driving direction.

5. The apparatus of claim 4, wherein said second cam surface moves said edge of said moving knife blade in a second direction away from said stationary knife blade and opposite said second direction into contact with said stationary knife blade, and said moving knife blade is moved in said first direction in contact with said stationary knife blade, and wherein said moving knife blade is moved opposite said first direction as said stationary knife blade is held away from said stationary knife blade.

6. The apparatus of claim 1, wherein said paper feed driving clutch mandrel, said paper feed driven clutch mandrel, and said paper feed driving clutch spring extend concentrically within said cam driving clutch mandrel and said cam driving clutch spring.

7. A paper cutter for a printer, wherein said paper cutter comprises:

a stationary knife blade;

a moving knife blade;

a blade holder holding said moving knife blade and moving with said moving knife blade;

first drive means for moving an edge of said moving knife blade in a first direction across an edge of said stationary knife blade to cut a paper web extending between said moving knife blade and said stationary knife blade, and for moving said edge of said moving knife blade opposite said first direction; wherein said first drive means includes a first cam surface turning in engagement with said blade holder, and wherein said first cam surface forms an eccentric cylinder turning within a channel extending from said blade holder; and second drive means for moving said edge of said moving knife blade in a second direction away from said stationary knife blade and opposite said second direction into contact with said stationary knife blade, wherein said moving knife blade is moved in said first direction in contact with said stationary knife blade, and wherein said moving knife blade is moved opposite said first direction as said stationary knife blade is held away from said stationary knife blade, wherein said second drive means includes a second cam surface turning with said first cam surface in engagement with said blade holder.

8. The paper cutter of claim 7, wherein said second drive means additionally includes a spring holding a contact portion of said blade holder against said second cam surface.

9. The paper cutter of claim 7, wherein said first and second cam surfaces form peripheral surfaces of a drive cam.

10. A paper cutter for a printer, wherein said paper cutter comprises:

a stationary knife blade;

a moving knife blade;

a blade holder holding said moving knife blade and moving with said moving knife blade;

first drive means for moving an edge of said moving knife blade in a first direction across an edge of said stationary knife blade to cut a paper web extending between said moving knife blade and said stationary knife blade, and for moving said edge of said moving knife blade opposite said first direction; and second drive means for moving said edge of said moving knife blade in a second direction away from said stationary knife blade and opposite said second direction into contact with said stationary knife blade, wherein said moving knife blade is moved in said first direction in contact with said stationary knife blade, and wherein said moving knife blade is moved opposite said first direction as said moving knife blade is held away from said stationary knife blade.

11. The paper cutter of claim 10, wherein said first drive means includes a first cam surface turning in engagement with said blade holder, and said second drive means includes a second cam surface turning with said first cam surface in engagement with said blade holder.

12. The paper cutter of claim 11, wherein said second drive means additionally includes a spring holding a contact portion of said blade holder against said second cam surface.

13. The paper cutter of claim 11, additionally comprising a drive cam having first and second peripheral surfaces, wherein said first cam surface extends along said first peripheral surface, and wherein said second cam surface extends along said second peripheral surface.

14. The paper cutter of claim 13, additionally composing:

a clutch mandrel;

a motor driving said clutch mandrel in a cam driving direction, and opposite said cam driving direction;

a cam driving tab extending from said drive cam adjacent said clutch mandrel;

an interposer tab extending from said blade holder adjacent said clutch mandrel; and a clutch spring extending around said clutch mandrel, wherein said clutch spring includes a first end tab extending outward to engage a first side of said cam driving tab and said interposer tab, wherein said clutch spring engages said clutch mandrel when a force is applied to said first end tab opposite said cam driving direction, and wherein said clutch spring disengages from said clutch mandrel when a force is applied to said first end tab in said cam driving direction.

15. The paper cutter of claim 14, wherein said second cam surface moves said blade holder to hold said interposer tab away from said first end tab as said first end tab passes adjacent said interposer tab with said first end tab in contact with said cam driving tab, said second cam surface moves said blade holder to bring said interposer tab into alignment with said first end tab as said first end tab moves beyond said interposer tab in said cam driving direction with said first end tab in contact with said cam driving tab, and said first end tab causes said clutch spring to disengage from said clutch mandrel as said first end tab engages said interposer tab with said clutch mandrel being driven opposite said cam driving direction.

16. The paper cutter of claim 15, wherein said interposing tab extends at an acute angle with respect to a path of motion of said first end tab, allowing said first end tab to move around said interposing tab as said first end tab passes adjacent said interposer tab in said cam driving direction with said first end tab out of contact with said cam driving tab.

17. The paper cutter of claim 16, wherein said clutch spring additionally includes a second end tab engaging a second side of said cam driving tab, opposite said first side of said cam driving tab, as said clutch spring is rotated opposite said cam driving direction, and said clutch spring engages said clutch mandrel when a force is applied to said second end tab in said cam driving direction.

18. The paper cutter of claim 10, wherein said blade holder slides and pivots along an attachment end of said blade holder, with said attachment end being opposite said moving knife blade.

19. The paper cutter of claim 18, wherein said attachment end includes a strip sliding and pivoting between two fulcrum points directed toward said strip from each side of said strip.

20. The paper cutter of claim 19, wherein sliding movement of said blade holder is controlled by a pair of parallel arms of equal length, each of which is pivotally mounted at a first end to a stationary frame member and at a second end to said blade holder.

* * * * *